United States Patent [19]

Smith

[11] Patent Number: 4,632,874

[45] Date of Patent: Dec. 30, 1986

[54] FILAMENT COHERENCY ENHANCING COMPOSITION AND TEXTILE YARNS COATED THEREWITH

[75] Inventor: James L. Smith, Kingsport, Tenn.

[73] Assignee: Eastman Kodak Company, Rochester, N.Y.

[21] Appl. No.: 789,283

[22] Filed: Oct. 18, 1985

[51] Int. Cl.[4] ..... B32B 27/00; C08K 5/34; C08K 5/52

[52] U.S. Cl. ..... 428/394; 428/395; 524/106; 524/140; 524/602; 524/603

[58] Field of Search ..... 524/602, 603, 140, 106; 428/394, 395

[56] References Cited

U.S. PATENT DOCUMENTS

| | | | |
|---|---|---|---|
| 3,734,874 | 5/1973 | Kibler et al. | 524/603 |
| 3,779,993 | 12/1973 | Kibler et al. | 528/250 |
| 3,977,979 | 8/1976 | Crossfield et al. | 524/106 |
| 4,039,715 | 8/1977 | Carver | 428/394 |
| 4,126,564 | 11/1978 | Marshall et al. | 428/395 |
| 4,156,073 | 5/1979 | Login | 524/603 |
| 4,233,196 | 11/1980 | Sublett | 524/603 |
| 4,304,900 | 12/1981 | O'Neill | 524/603 |

*Primary Examiner*—Lewis T. Jacobs

*Attorney, Agent, or Firm*—Malcolm G. Dunn; William P. Heath, Jr.

[57] ABSTRACT

Substantially homogeneous aqueous composition for use in imparting coherency to textile filaments, and textile yarns having dried coatings thereon of such composition; the composition comprising a major amount of an emulsifiable textile finishing oil and a minor amount of water dissipatable polymer.

20 Claims, No Drawings

FILAMENT COHERENCY ENHANCING COMPOSITION AND TEXTILE YARNS COATED THEREWITH

TECHNICAL FIELD

The present invention is directed to a substantially homogeneous aqueous composition for use in imparting coherency to textile filaments and to textile yarns having dried coatings thereon of such composition.

Filaments of any yarn must to some degree have coherency to prevent the filaments or fibers from becoming tangled masses. Yarns made from staple fibers are conventionally held together by twist. When continuous filament synthetic yarns were first introduced around the turn of the century, twist was used to provide filament coherency. About 20 years ago entanglement was introduced to avoid the expense of putting a twist in the yarn so as to provide coherency for the yarn. It is also known to combine filament entaglement with twist to provide filament coherency to continuous filaments. Entanglement is achieved with composed air-driven entangling jets is taught in the prior art.

The advantage of twist is that the coherency imparted to the yarn is permanent. It cannot be pulled out during processing. The disadvantages, however, are due to cost and package size limitations.

Filament entanglement is more reasonable in cost, and large parallel packages (i.e., no twist is imparted during winding) can be produced. The degree of entanglement, however, is critical, depending upon the end use, and it is difficult to control. Also, filament entanglement is not permanent. When passing such yarns under tension over guides, the level of entanglement will be reduced and the remaining entanglement will tend to bunch up in knots. These tightly entangled places can be seen in most woven fabrics and serve to reduce the aesthetic appeal of the fabrics. One solution is to produce yarn containing both twist and entanglement. This results in a compromise of the advantages and disadvantages of both. The cost of producing a yarn with twist only, therefore, is reduced since some twist is replaced with entanglement, but the twist helps in entanglement retention to some degree.

Another method for producing coherency is to use a chemical bonding agent to hold together the filaments of a continuous filament yarn. Canadian Pat. No. 833083 (issued on Jan. 27, 1970), for instance, discloses a textile/finishing composition comprising mineral oil; polybutene having a number average molecular weight (Osometer method) of from about 150 to about 750, more particularly from about 200 to about 500, and specifically about 320; an alkyl or alkenyl acid phosphate containing from about 13 to about 19 carbon atoms in the alkyl or alkenyl grouping thereof; e.g. oleyl acid phosphate, palmityl acid phosphate, etc.; and an oxidized (autoxidized) vegetable oil; e.g. oxidized soybean oil. The Canadian patent discloses as an option "but preferably" also one or both of the following: a phenolic antioxidant, specifically di-(tertiary-butyl)-p-cresol; and/or di-(lower-alkyl)aminoalkanol containing from 2 through 5 carbon atoms in the alkanol grouping thereof, specifically di-n-butylaminoethanol. The textile-finishing compositions are prepared by blending together the various components "in any suitable manner." The finish, according to the Canadian patent, may be applied to freshly extruded filamentary yarn or during beaming, knitting, weaving, or other operations. The particular yarn disclosed is secondary cellulose acetate; however, the finishing composition may be used on other cellulose ester fibers such as cellulose propionate, cellulose butyrate, cellulose acetatebutyrate, and cellulose acetate.

It should be noted that the finishing composition described in the Canadian patent above is highly viscous. Highly viscous compositions are more difficult to apply evenly to yarns and will produce excessive drag or tension on the yarn. Yarns from cellulose acetate when freshly emerging from the spinning cabinet will have exceptionally weak filaments. The extra tension which can be caused by a highly viscous yarn finish will cause breakage of the filaments.

The patent teaches adjusting the viscosity by controlling the temperature of the liquid finish. Such temperature control, however, adds to the cost of making the yarn.

The polymeric component in the aqueous composition of this invention is in the form of a dispersion. In such form the polymer does not substantially increase the viscosity of the aqueous emulsion of textile finishing oils in which it is dispersed. Since it is dispersed and not soluble, as is the polymer in Canadian Pat. No. 833083, no problems of application to yarn due to viscosity are encountered.

The substantially homogeneous aqueous composition of the present invention is coated on textile yarns immediately after the yarns have been spun, and then the yarns are wound onto a package while the coating on the yarns is still wet. It is surprising and unexpected that after the yarn package has been given sufficient time to dry, the yarn may be readily and easily withdrawn from the package without having become bonded to the yarn package in one solid mass, and yet the individual filaments forming the yarn are cohesively held together to the extent that the yarns are useful as filling yarns on high speed looms such as air jet looms and high speed weaving machines. More surprising still, polyester partially oriented yarns (POY) having this coating may be extensively drafted (some as much as 253%) without the cohesion between the filaments of the yarn from being completely lost, yet the coating thereon may be readily removed from fabrics into which the yarns have been woven, etc., by conventional scouring techniques.

The substantially homogeneous aqueous composition disclosed herein includes a water dissipatable polymer comprising a dispersed linear polyester or polyester amide or mixtures thereof, as disclosed in the Kibler and Lappin patents, U.S. Pat. No. 3,734,874 and U.S. Pat. No. 3,779,993, the disclosures therein being incorporated herein by rererence.

Both polyesters and polyesteramides as defined in the Kibler and Lappin patents have the same characteristic of being water dissipatable.

In accordance with one aspect in the patents, a linear, water dissipatable, meltable polyester or polyesteramide, having an inherent viscosity of at least 0.1 and advantageously (in some cases) at least 0.3, is prepared from a glycol component, a dicarboxylic acid component, and a difunctional monomer component. The components used in the polymer condensation products are all essentially difunctional which means that they cannot contain other substituents such as isocyanate groups since any such third functional group would mean that the compound was trifunctional. The two functional groups which are present condense to form carbonyloxy or cabonylamido interconnecting groups in the linear molecular structure. The glycol component advantageously comprises at least about 15 mole percent of at least one poly(ethylene glycol) having the formula:

$$H(OCH_2—CH_2)_nOH$$

wherein n is 2 to about 20.

More especially, the patents disclose providing a linear, water dissipatable polymer having carbonyloxy interconnecting groups in the linear molecular structure wherein up to 80% thereof may be carbonylamido linking groups, the polymer having an inherent viscosity of at least about 0.1 measured in a 60/40 parts by weight solution of phenol/tetrachloroethane at 25° C. and at a concentration of about 0.25 gram of polymer in 100 ml. of the solvent, the polymer consisting essentially of at least (a), (b), and (c) from the following components:

(a) at least one difunctional dicarboxylic acid;

(b) at least one difunctional glycol containing two —$CR_2$—OH groups of which at least 15 mole percent is a poly(ethylene glycol) having the structural formula:

$$H(OCH_2—CH_2)_nOH$$

n being an integer in the range between about 2 and about 20;

(c) an amount sufficient to provide the water dissipatable characteristic of the polymer of at least one difunctional sulfo-monomer containing at least one metal sulfonate group attached to an aromatic nucleus wherein the functional groups are hydroxy, carboxyl or amino; and (d) from none to an amount of a difunctional hydroxycarboxylic acid having one —$CR_2$—OH group, an aminocarboxylic acid having one —NRH group, an aminoalcohol having one —$CR_2$—OH group and one —NRH group, a diamine having two —NRH groups, or a mixture thereof, wherein each R is an H atom or a 1–4 carbon alkyl group, said components (a), (b), (c), and (d) being organic compounds, each of which contains a hydrocarbon moiety which has from none up to six nonfunctional groups.

According to one aspect of the disclosure in the patents, there is provided a polymer which is a polyester wherein the difunctional sulfo-monomer is a dicarboxylic acid and constitutes about 8 mole percent to about 50 mole percent based on the sum of (1) the moles of the total dicarboxylic acid content of components (a) and (b), and (2) one half of the moles of any hydroxycarboxylic acid content from the component (d).

According to more specific embodiments, such polyesters are provided wherein the difunctional sulfomonomer (c) is a glycol and constitutes about 8 mole percent to abut 50 mole percent based on the sum of (1) the total glycol content measured in moles of (b) and (c), and (2) one half of the moles of any hydroxycarboxylic acid content from the component (d).

The aforesaid range is most preferably from about 10 up to about 50 mole percent.

Examples of suitable poly(ethylene glycols) include diethylene glycol, triethylene glycol, tetraethylene glycol, and pentaethylene, hexaethylene, heptaethylene, octaethylene, nonaethylene, and decaethylene glycols, and mixtures thereof. Preferably the poly(ethylene glycol) employed in the polyesters or polyesteramides of the patent is diethylene glycol or triethylene glycol or mixtures thereof. The remaining portion of the glycol component may consist of aliphatic, alicyclic, and aralkylglycols. Examples of these glycols include ethylene glycol; propylene glycol; 1,3-propanediol; 2,4-dimethyl-2-ethylhexane-1,3-diol; 2,2-dimethyl-1,3-propanediol; 2-ethyl-2-butyl-1,3-propanediol; 2-ethyl-2-isobutyl-1,3-propanediol; 1,3-butanediol; 1,4-butanediol; 1,5-pentanediol; 1,6-hexanediol; 2,2,4-trimethyl-1,6-hexanediol; thiodiethanol; 1,2-cyclohexanedimethanol; 1,3-cyclohexanedimethanol; 1,4-cyclohexanedimethanol; 2,2,4,4,-tetra-methyl-1,3-cyclobutanediol; p-xylylenediol. Copolymers may be prepared from two or more of the above glycols.

The dicarboxylic acid component of the polyester or polyesteramide comprises aliphatic dicarboxylic acids, alicyclic dicarboxylic acids, aromatic dicarboxylic acids, or mixtures of two or more of these acids. Examples of such dicarboxylic acids include oxalic; malonic; dimethylmalonic; succinic; glutaric; adipic; trimethyladipic; pimelic; 2,2-dimethylglutaric, azelaic; sebacic; fumaric; maleic; itaconic; 1,3-cyclopentanedicarboxylic; 1,2-cyclohexanedicarboxylic; 1,3-cyclohexanedicarboxylic; 1,4-cyclohexanedicarboxylic; phthalic; terephthalic; isophthalic; 2,5-norbornanedicarboxylic; 1,4-naphthalic; diphenic; 4,4'-oxydibenzoic; diglycolic; thiodipropionic; 4,4'-sulfonyldibenzoic; and 2,5-naphthalenedicarboxylic acids. If terephthalic acid is used as the dicarboxylic acid component of the polyester, superior results are achieved when at least 5 mole percent of one of the other acids listed above is also used.

It should be understood that use of the corresponding acid anhydrides, esters, and acid chlorides of these acids is included in the term "dicarboxylic acid." Examples of these esters include dimethyl 1,4-cyclohexanedicarboxylate; dimethyl 2,6-naphthalenedicarboxylate; dibutyl 4,4'-sulfonyldibenzoate; dimethyl isophthalate; dimethyl terephthalate; and diphenyl terephthalate. Copolyesters may be prepared from two or more of the above dicarboxylic acids or derivatives thereof.

The difunctional sulfo-monomer component of the polyester or polyesteramide, as disclosed in the patents, may advantageously be a dicarboxylic acid or an ester thereof containing a metal sulfonate group or a glycol containing a metal sulfonate group. The metal ion of the sulfonate salt may be $Na^+$, $Li^+$, $K^+$, $Mg^{++}$, $Ca^{++}$, $Cu^{++}$, $Ni^{++}$, $Fe^{++}$, $Fe^{+++}$ and the like. When a monovalent alkali metal ion is used the resulting polyesters or polyesteramides are not ordinarily easily dissipated by cold water but are more readily dissipated in hot water. Depending on the end use of the polymer, either of the differential sets of properties may be desirable. It is possible to prepare the polyester or polyesteramide using, for example, a sodium sulfonate salt and later by ion-exchange replace this ion with a different ion, for example, calcium, and thus alter the characteristics of the polymer. In general, this procedure is superior to preparing the polymer with divalent metal salts inasmuch as the sodium salts are usually more soluble in the polymer manufacturing components than are the divalent metal salts. Polymers containing divalent or trivalent metal ions are less elastic and rubber-like than polymers containing monovalent ions. The difunctional monomer component may also be referred to as a difunctional sulfomonomer and is further described hereinbelow.

Advantageous difunctional components which are aminoalcohols include aromatic, aliphatic, heterocyclic and other types as in regard to component (d). Specific examples include 5-aminopentanol-1, 4-aminomethylcyclohexanemethanol, 5-amino-2-ethyl-pentanol-1, 2-(4-β-hydroxyethoxy-phenol)-1-aminoethane, 3-amino-2,2-dimethylpropanol, hydroxyethylamine, etc. Generally these aminoalcohols contain from 2 to 20 carbon atoms, one —NRH group and one —$CR_2$—OH group.

Advantageous difunctional monomer components which are aminocarboxylic acids include aromatic, aliphatic, heterocyclic, and other types as in regard to component (d) and include lactams. Specific examples include 6-aminocaproic acid, it lactam known as caprolactam, omegaaminoundecanoic acid, 3-amino-2-dimethylpropionic acid, 4-β-aminoethyl)benzoic acid, 2-(β-aminopropoxy)benzoic acid, 4-aminomethylcyclohexanecarboxylic acid, 2-(β-aminopropoxy)cyclohexanecarboxylic acid, etc. Generally these compounds contain from 2 to 20 carbon atoms.

Advantageous examples of difunctional monomer component (d) which are diamines include ethylenediamine; hexamethylenediamine; 2,2,4-trimethylhexamethylenediamine; 4-oxaheptane-1,7-diamine, 4,7-dioxadecane-1,10-diamine; 1,4-cyclohexanebismethylamine; 1,3-cyclohexanebismethylamide; heptamethylenediamine; dodecamethylenediamine, etc.

Advantageous difunctional sulfo-monomer components are those wherein the sulfonate salt group is attached to an aromatic acid nucleus such as a benzene, naphthalene, diphenyl, oxydiphenyl, sulfonyldiphenyl, or methylenediphenyl nucleus. Preferred results are obtained through the use of sulfophthalic acid, sulfoterephthalic acid, sulfoisophthalic acid, 4-sulfonaphthalene-2,7-dicarboxylic acid, and their esters; metallosulfoaryl sulfonate (as described in Lappin, Kibler, Gilmer, and Jones U.S. Pat. No. 3,582,947, issued Sept. 15, 1970) having the general formula

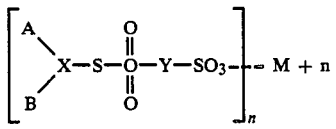

wherein X is a trivalent aromatic radical derived from a substituted or unsubstituted aromatic hydrocarbon, Y is a divalent aromatic radical derived from a substituted or unsubstituted aromatic hydrocarbon, A and B are carboalkoxy groups containing 1 to 4 carbon atoms in the alkyl portion or a carboxy group, M is Li+, Na+, K+, Mg++, Ca++, Cu++, Fe++, Fe+++, and n is 1 for monovalent M or 2 for divalent M. The preceding sulfomonomer compounds may be prepared as shown by the following general reactions which are exemplified in the examples below:

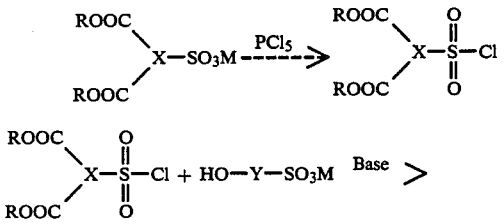

-continued

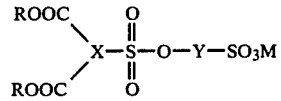

Many variations of these reactions may be employed. For example, the sulfonyl chloride intermediate may be prepared from either the sulfonic acid or a salt thereof, and other chlorinating agents (e.g., thionyl chloride, phosphorus trichloride, phosphorus oxychloride) may be used. In addition, the reaction between the sulfonyl chloride and the sulfophenol may be carried out in water or an inert organic solvent, and the base used may be an alkali metal hydroxide or a tertiary amine.

The polymer compositions in these patents are disclosed as having particular utility in the paper-using industry as a hot-melt adhesive which will dissipate in aqueous or caustic solutions. Certain of the polymer compositions disclosed in the patents have been used on fibers such as polyester, nylon, cellulose acetate, cellulose triacetate, poly(vinyl chloride), and are mentioned in the patents as being sizing agents. Sizing agents, however, perform a different function in their use on yarns, and are applied differently from the application disclosed in the present invention. Sizing agents are generally used on yarns which are to be warps on a loom or weaving machine so as to enable the yarns coated therewith to withstand the abrasive motion of the reeds during weaving. The Dunlap et al patent, U.S. Pat. No. 3,634,295 (issued on Jan. 11, 1972), for instance, discusses how a typical sizing process operates. For example, the yarn that is to become the warp in a weaving machine is passed through a size box or trough containing the sizing composition. Any excess of the sizing composition is removed from the yarn by passing it through squeeze rolls, and then the yarn passes over heated cylinders or passes through an oven to dry the yarn.

Only the dried yarn is then wound onto beams and the like. The yarns do not stick to the beam because the sizing composition is completely dry before the yarn is wound into the beam. The filaments of the yarn are cohesively held together, and the resulting yarn or warp feels heavy and stiff which it must be to withstand the aforementioned abrasive motion of the reeds during weaving. The drying operation described above also adds to the cost of producing yarn.

In the present invention, an oil-in-water emulsion containing a water dissipatable polymer as a minor component is laid down as a lubricant on textile yarns comprised of continuous filaments. The water is removed by drying, leaving the residue uniformly distributed in the filaments. The residue contains a minor portion of water dissipatable polymer distributed through the lubricant.

It is an object of the invention to provide a sutstantially homogeneous aqueous composition for use in imparting coherency to textile filaments so as to produce yarns having even little or no twist or entanglements and wherein the filaments of the yarn are cohesively held together and are capable of remaining essentially together when the yarn is used as filling yarns for air jet weaving machines, or for any other type of operation such as in a knitting operation, for instance.

Another object of the invention is to provide textile yarns coated with the coating disclosed herein and which do not have to be dried or cooled during manufacturing prior to the yarns being wetted by the coating, passing over rolls and/or guides and being wound onto packages.

Still another object of the invention is to provide a continuous filament yarn coated with the coating disclosed herein which may be produced without curing or drying during manufacture, will dry or cure while on the yarn package and yet the filaments will be significantly bonded without the yarn becoming stuck to the yarn package so that they can later be readily withdrawn at high speeds without damage to the yarn filament or sloughing from the package.

A further object of the invention is to manufacture continuous filament yarns having uniform coherency of filaments from end to end at a lower cost than twisted or air-entangled yarns.

DISCLOSURE OF THE INVENTION

In accordance with the present invention, I provide a substantially homogeneous aqueous composition for use in imparting coherency to textile filaments, the composition comprising an emulsifiable textile finishing oil and a water dissipatable polymer at a weight ratio of from about 19/1 to 5/1 and water comprising from about 90 to about 70 wt. % of the total composition wherein the water dissipatable polymer comprises the reaction products of (a), (b), (c), and (d) from the following components of ester forming or esteramide forming derivatives thereof: (a) at least one difunctional dicarboxyic acid; (b) from about 4 to about 25 mole percent based on a total of all acid, hydroxyl and amino equivalents being equal to 200 mole percent, of at least one difunctional sulfomonomer containing at least one metal sulfonate group attached to aromatic nucleus wherein the functional groups are hydroxy, carboxyl or amino; (c) at least one difunctional reactant selected from a glycol or a mixture of a glycol and diamine having two —NRH groups, the glycol containing two —$CH_2$—OH groups of which at least 15 mole percent based on the total mole percent of hydroxy or hydroxy and amino equivalents, is a poly(ethylene glycol) having the structural formula $H(OCH_2—CH_2)_nOH$, n being an integer of between 2 and about 20; and (d) from none to at least one difunctional reactant selected from a hydroxycarboxylic acid having one —$CH_2$—OH, an aminocarboxylic acid having one —NRH group, an aminoalcohol having one —$CR_2$—OH group and one —NRH or mixtures thereof, wherein each R is an H atom or an alkyl group of 1 to 4 carbon atoms.

The composition may also include at least one difunctional reactant from (d) in the aforementioned water dissipatable polymer.

The metal of the sulfonate group may be selected from the group consisting of Na, Li, K, Mg, Ca, Cu, Ni, Fe and mixtures thereof.

The oil may be selected from either or a mixture of (1) mineral oils having a viscosity of about 40 to about 60 SUS at 100° C. and (2) metal or amine salts of alkyl acid phosphates.

The phosphates have the general formula

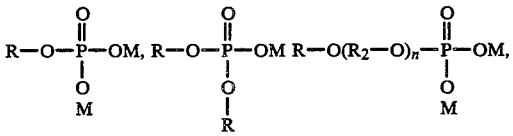

-continued

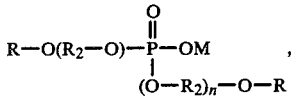

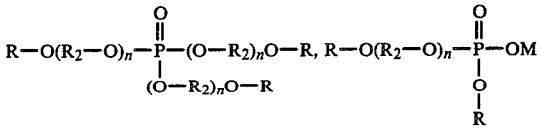

(1) where M is an amine, sodium, potassium or lithium;

(2) R is a carbon atom chain containing from 8 to 22 carbon atoms and the chains can be either saturated or unsaturated; also the R's on any molecule can be alike or different;

(3) $R_2$ is a saturted carbon chain of 2 or 3 carbon atoms;

(4) n is an integer of from 2 to about 20.

The oil may comprise in weight percent from about 3 to about 5 oleic acid, from about 3 to about 6 diethylaminoethanol, from about 4.5 to about 5.5 1-(2-lactamidoethyl)-2-(heptadecenyl)-2-imidazoline salt of lactic acid, from about 4 to about 7 oxidized neatsfoot oil, from about 50 to about 60 mineral oil 50 SUS at 100° F., from about 3 to about 7 diethylaminoethanol salt of oleyl sulfate, from about 1 to 3 orthophenylphenol, from about 6 to about 10 2-methoxy-1-methylethylpalmitate, from about 2 to about 5 sorbitan monopalmitate, from about 2 to about 5 poly(oxyethylene)(16) sorbitan monostearate.

The oil may also comprise in weight percent from about 50 to about 60 butyl stearate, from about 20 to about 30 poly(oxyethylene)(8) dinonylphenol, from about 12 to about 18 poly(oxyethylene)(30) castor oil, from about 2 to about 5 sodium dodecylbenzenesulfonate, from about 2 to about 15 poly(oxyethylene)(5) lauryl potassium phosphate.

The water dissipatable polymer used in conjunction with either of the above-described oils may be prepared from diethylene glycol and 1,4-cyclohexanedimethanol in a molar ratio of from about 53/47 to about 60/40 and 5-sodiosulfoisophthalic acid and isophthalic acid in a molar ratio of about 16/84 to about 20/80.

The water dissipatable polymer used in conjunction with the first-described oil above may also be prepared from diethylene glycol and 5-sodiosulfoisophthalic acid and isophthalic acid in a molar ratio of about 10/90 to about 13/87.

The water dissipatable polymer used in conjunction with either of the above-described oils may further be prepared from diethylene glycol and hexamethylenediamine in a molar ratio of about 75/25 to about 65/35 and 5-sodiosulfoisophthalic acid and isophthalic acid in a molar ratio of about 16/84 to about 20/80.

The ratio of the textile emulsifiable finishing oil to water dissipatable polymer is in a ratio by weight of about 96/4 to about 85/15 and the water is about 80 wt. % of the total composition.

In accordance with the present invention I also provide textile yarns having dried coatings thereon of any of the compositions described above, the dried coatings being present at a concentration of about 0.5 to about 3.0 wt. % based upon yarn weight.

The textile yarns containing the dried coating thereon are continuous filament yarns, and the yarns may be cellulose acetate, polyester, polypropylene, acrylic or nylon.

BEST MODE FOR CARRYING OUT THE INVENTION

Cellulose acetate yarn, for example, is conventionally dry spun from an acetate solution at about 600 to 800 meters per minute. The solution is extruded from small holes in a spinneret into a spinning cabinet being flushed with warm air to evaporate and remove the acetone. The bundle of yarn filaments upon leaving the bottom of the cabinet tangentially contacts a kiss roll rotating in a trough of finishing oil. The finishing oil is conventionally a neat oil mixture (that is, it contains no water), consisting primarily of mineral oil. It is not unknown, however, to use an emulsion of an oil mixture.

After the kiss roll, the yarn passes around a Godet roll to one or more guides and then to a parallel winder or to the traveler on the ring of a ring winder and finally to a rotating bobbin.

If filament entanglement is to be inserted, a compressed air entangling jet can be located in any location prior to winding so long as the entanglement is snubbed such that it cannot proceed up the spinning cabinet since that would cause the end to break down. These procedures are conventional, are taught in the patent literature, and are well known in the art. They are only mentioned here to provide a comparison to the preferred procedure as disclosed in this invention.

The utility of the invention can be easily understood as illustrated in the discussion below.

It is recognized in the textile arts that a yarn must be designed for specific textile uses. The examples below illustrate that filament coherency enhancing properties can be imparted to filament yarns by the practice of this invention. The design of specific yarns for specific end uses is best left to the textile engineers and designers who now, by practicing the arts taught in this invention, can design improved yarns that can be produced at a reduced cost.

EXAMPLES

Definitions of Polymers and a Polyesteramide Used in Examples

A polyester made in accordance with the disclosure in the above-mentioned Kibler and Lappin patents consisting of 83 mole percent isophthalic acid unit, 18 mole percent of 5-sodiosulfoisophthalic acid units, and the glycol portion consisting of 57 mole percent diethylene glycol and 46 mole percent 1,4-cyclohexanedimethanol or poly(57/43 diethyleneglycol/1,4-cyclohexanedimethanol-18/82 5-sodiosulfoisophthalate/isophthalate) will herein be referred to as Polymeric Material 1.

A polyester, poly(diethyleneglycol-11/89, 5-sodiosulfoisophthalate/isophthalate) will herein be referred to as Polymeric Material 1.

A polyester, poly(diethyleneglycol-11/89, 5-sodiosulfoisophthalate/isophthalate) will herein be referred to as Polymeric Material 2.

A polyesteramide poly(35/65 hexymethylenediamino/diethyleneglycol-15/85, 5-sodiosulfoisophthalate/isophthalate) will herein be referred to as Polymeric Material 3.

Definitions of Finishing Oil Mixtures Used in the Examples

Various finishing oil mixtures have been used. Three are included as examples and are designated as A, B, and C.

Composition of Finishing Oil Mixture herein referred to as A 1. oleic acid, 4.1 parts
2. diethyl ethanolamine, 3.7 parts
3. 1-(2-lactamidoethyl)-2-(heptadecenyl)-2-imidazoline salt of lactic acid, 4.8 parts
4. blown (oxidized) neatsfoot oil, 4.8 parts
5. mineral oil 50 SUS seconds at 100° C., 54.8 parts
6. diethylaminoethanol salt of oleyl sulfate, 5.35 parts
7. orthophenylphenol, 2 parts
8. 2,methoxy-1-methylethyl palmitate, 8.2 parts
9. sorbitan monopalmitate, 3.8 parts
10. poly(oxyethylene)(16) sorbitan monostearate, 3.8 parts Composition of Finishing Oil Mixture herein referred to as B 1. butyl stearate, 55 parts
2. poly(oxyethylene)(8) dinonylphenol, 25 parts
3. poly(oxyethylene)(30) castor oil, 15 parts
4. sodium dodecyl benzene sulfonate, 3 parts
5. poly(oxyethylene)(5) lauryl potassium phosphate, 2 parts Composition of Finishing Oil Mixture herein referred to as C 1. mineral oil, viscosity of 50 SUS at 100° F., 51 parts
2. decyl,tridecyl, secondary orthophosphate, 17 parts
3. diethanolamine salt of coconut oil fatty acids, 17 parts
4. di(tert,amyl phenol), 2.1 parts
5. triethanolamine, 2.7 parts
6. poly(oxyethylene) sorbitan monooleate, 10 parts It is understood that the above finishing oil mixtures are only included as being typical of finishing oils in general and that other typical mixtures of agents used as finishes on yarns can be used within the concept of the invention providing that the oils are emulsifiable.

Generalized Examples for Preparation of (a) Emulsions of Finishing Oils, (b) Dispersions of Polymers, and (c) Emulsion-Dispersion Compositions The mixing of the Finishing Oil Mixtures with the polyesters and/or polyamides to produce aqueous emulsion-dispersion compositions is not particularly difficult. In general, I have found it best to make an aqueous emulsion of the Finishing Oil Mixture. Then, separately, make the aqueous dispersion of the polyester, amide, or mixture of the two. In a third step the emulsion and the dispersion are combined.

I prepare the mixture of finishing oil components, which must include at least one emulsifying agent, in a conventional way. The oil mixture and the water are heated to about 50° C. While slowly stirring the oil, the water is added in small increments to produce an emulsion of the desired concentration. Typically, when only a small amount of water has been added there first forms in water-in-oil emulsion. On the addition of additional water, the emulsion inverts to oil in water.

The dispersions of the polyesters, amides, or mixtures of them are prepared by stirring them with water at about 90° C. until by observation the particulate matter has disappeared, and then the dispersion is cooled or used while still warm to mix with an emulsion of the finishing oil components. These dispersions are suspensions of very fine particulate matter. They are so fine that one might consider them solutions, but these solutions are not completely clear and usually have a slightly yellow tint. One, also, can make more concentrated stock solution, typically 20% to 30%, that can later be diluted on demand for the sake of convenience.

After the emulsion and the dispersion have been prepared, I have found that they can be combined by adding the aqueous dispersion to the stirred aqueous emulsion while both are maintained at a moderate temperature of about 30° C. to 60° C. to produce emulsion-dispersion compositions.

Examples for the Preparation of Emulsion-Dispersion Compositions

An example for the preparation of an emulsion of finishing oils, a dispersion of a polyester and the combining of the two to produce an emulsion-dispersion ready for application to yarns follows:

Thirty-seven parts of Finishing Oil Mixture A were emulsified at 40° C. by slowly adding 106 parts water while stirring. 5.2 parts of Polymeric Material 1 were dispersed in 94.8 parts of water by stirring at 90° C., for 45 minutes. The dispersion was slowly added at 40° C. to the emulsion. The quantity of dispersion added was sufficient to make the solids of the emulsion-dispersion 7.5% polymeric material. After stirring an additional 30 minutes the emulsion-dispersion was allowed to cool to room temperature. This composition is designated Composition I in the table below.

In a similar manner the other compositions given in the Table below were prepared.

TABLE I

| Composition | Finishing Oil Mixture | Polymeric Material | % Polymeric Material in Mixture of Oil and Polymer | % Oil & Polymer Mixture in Aqueous Emulsion-Dispersion |
|---|---|---|---|---|
| I | A | 1 | 7.5 | 20 |
| II | B | 1 | 7.5 | 20 |
| III | A | 2 | 7.5 | 20 |
| IV | B | 2 | 7.5 | 20 |
| V | A | 1 | 10.0 | 20 |
| VI | B | 3 | 15.0 | 25 |
| VII | B | 3 | 7.5 | 35 |

Application of Emulsion-Dispersion Compositions to Yarns

The emulsion-dispersions prepared and defined above as Compositions I, II, etc., were applied to various yarns intended for different textile end uses and found to provide filament coherency enhancing properties of economic importance in that the need for filament entanglement and/or twist was reduced or eliminated.

Example: Preparation of Acetate Yarns with Filament Coherency Enhanced Properties An embodiment of the invention for the preparation of an acetate yarn for use as a filling yarn for insertion on an air jet high speed weaving machine and warp knitting follows.

Composition I was applied with a kiss type conventional oil roll to acetone, dry spun actate yarns running at 618 meters per minute. After Composition I was applied at levels to yield yarns with finish concentrations targeted for 1, 2, and 3 percent based upon dry yarn weight, the yarns were passed around a Godet roll, through a pig-tail guide, and wound on surface driven parallel packages. The yarns were not dried prior to winding but did essentially dry on the packages prior to evaluation. Three control yarns were prepared in the same manner, only no aqueous disperson of polymeric material was added to the emulsion of finishing oil mixture.

The physical properties, strength, and elongation to break of the yarns were measured, and all were as expected for acetate yarn and not significantly different. The control yarns were twisted on a ring twister to one and one half turns per inch (tpi). Each yarn was inspected for broken filaments by visual inspection. The observer looked at an angle of 30 degrees to about 20 feet of the well-lit yarns while they are running at 150 yards per minute over a dark background and counted the number of defects per 100,000 yards.

| | Defects Per 100,000 Yards | | |
|---|---|---|---|
| | Percent Finish on the Yarns | | |
| | 0.9–1.1 | 1.9–2.1 | 2.9–3.0 |
| Yarns with Coherency-enhancing Finish | 5 | 3 | 8 |
| Control yarns, 1.50 turns/inch | 18 | 20 | 15 |

The preferred yarn, that with the coherency enhancing finish at 2%, decided on the basis of number of defects, most of which were broken filaments, was prepared on a larger scale, beamed, and knit on a warp knitter over nylon is a construction used for brushed robe fabrics. The knitting performance was such that an average of 520 racks was completed per end out. Control yarn with 1.5 tpi and 3% finish, the preferred control yarn, in the same knitting construction, knit at a performance level of 522 racks per end out. Brushed finished fabrics of both were equal and acceptable in appearance.

While there was no advantage in knitting performance or fabric appearance, the subject yarn of this invention is clearly shown to be preferred because it is clearly more economical to produce since no twist was needed.

The same two yarns were inserted at a rate of 520 picks per minute on a Nissan air jet weaving machine running a conventionally sized acetate warp, followed by a third yarn which was lubricated to 3% control finish and air entangled to 10 entanglements per inch with a compressed air jet while spinning. The fabrics produced were of a lightweight twill suitable for linings, a common fabric for acetate.

The weaving performances in terms of stops were all so good that it would have required several days of weaving to obtain meaningful results. But the air pressure requirements of the three were as follows:

| Yarn | Air Pressure (kilograms/sq. cm.) |
|---|---|
| Yarn with enhanced filament coherency | 1.45 |
| Control yarn with twist (1.5 tpi) | 2.20 |
| Control yarn with 10 entanglements/inch | 2.10 |

All fabrics were dyed blue of a medium shade before inspection.

Fabrics of the preferred yarn and the control yarn with twist were excellent and equivalent in appearance. Fabric woven with the control yarn containing entanglement was inferior due to short flashes or imperfections due to the entanglement. This type of defect is well known in the trade and is often called "flash."

The subject yarn of this invention is preferred for weaving over the conventional yarns because it is not only more economical to produce but also because it is more economical to weave due to reduced compressed air requirements. It is also equivalent or superior to conventional yarns in appearance when used as filling in woven fabrics.

Compositions II and III from table I were also prepared, applied to acetate yarns during spinning at a concentration after drying on the packages at essentially 2%, and examined for filament coherency. Composition II was about like Composition I. Composition III was slightly better for cohesion of filaments but caused a slight buildup of material on the package drive roll such that it had to be cleaned every eight hours of spinning.

Composition VII, which can be seen from Table I, has a high concentration of solids, was too viscous for ease of application with an oil roll. There seems to be a limit in the amount of solids one should use. If solids are too low, an excessive amount of water is applied. About 10 wt. % solids seems to be a practical lower limit to keep the yarn from being too wet.

Example: Preparation of Polyester Yarns with Filament Coherency Enhanced Properties Composition IV was metered with a lubricating tip located about four feet above a parallel winder onto partially oriented polyethylene terephthalate yarn during spinning. The yarn of 265 denier and 30 filaments was spun at 3000 meters per minute. The concentration of the finish applied was 1.65 percent based upon dry yarn weight. The resulting yarn showed a greater degree of filament coherency when the filaments were separated with a pick and then forced apart than did a control yarn which has been spun and lubricated in the same manner except that the polymeric material had not been added to the finishing emulsion. The subject yarn and the control yarn were then drafted at a draft ratio of 1.76 and conditioned, while running, in a hot air tube at 190° C. The two yarns were again examined for filament coherency. Separated filament bundles from the same yarn end when being manually pulled apart formed an angle of about 75 degrees while the equivalent angle formed by separating filaments of the control yarn was about 5 to 10 degrees.

The example above was repeated, only Composition VI was used in place of Composition IV. The separation angle was about 70 degrees and the angle corresponding to the control yarn was again very small, showing little cohesion.

Examples of Providing Coherency to Polypropylene, Acrylic, and Nylon Yarns.

Compositions IV, V and VI were applied with a kiss lubricating roll to preformed commercial polypropylene, acrylic, and nylon yarns having commercial finishes. Some yarns contained twist and some had entangled filaments. Compositions were tested at a concentration of essentially 2 wt. % after drying. All showed increased cohesive properties when the filaments were separated manually with picks or by manually separating the filaments and pulling. However, there were slight differences in filament cohesiveness. Composition VI was preferred for nylon yarns, IV for polypropylene, and there was no preferred composition for acrylic because they all provided some coherency.

It, of course, would be apparent to one skilled in the art to use the teaching of the present invention for textile yarns for imparting filament coherency to yarns having twist, entanglement, or both, as well as yarns having neither twist nor entanglement.

The invention has been described in detail with particular reference to preferred embodiments thereof, but it will be understood that variations and modifications can be effected within the spirit and scope of the invention.

I claim:

1. A substantially homogeneous aqueous composition for use in imparting coherency to textile filaments, comprising an emulsifiable textile finishing oil and water dissipatable polymer at a weight ratio of from about 19/1 to about 5/1 and water comprising from about 90 to about 70 wt. % of the total composition wherein said water dissipatable polymer comprises the reaction products of (a), (b), (c) and (d) from the following components or ester forming or esteramide forming derivatives thereof:

(a) at least one difunctional dicarboxylic acid;

(b) from about 4 to about 25 hole percent based on a total of all acid, hydroxyl and amino equivalents being equal to 200 mole percent, of at least one difunctional sulfomonomer containing at least one metal sulfonate group attached to aromatic nucleus wherein the functional groups are hydroxy, carboxyl or amino;

(c) at least one difunctional reactant selected from a glycol or a mixture of a glycol and diamine having two —NRH groups, the glycol containing two $$-CH_2-OH$$

groups of which at least 15 mole percent based on the total mole percent of hydroxy or hydroxy and amino equivalents, is a poly(ethylene glycol) having the structural formula:

$$H(OCH_2-CH_2)_nOH$$

n being an integer of between 2 and about 20; and (d) from none to at least one difunctional reactant selected from a hydroxycarboxylic acid having one $-CH_2-OH$, an aminocarboxylic acid having one —NRH group, an amino-alcohol having one $$-CR_2-OH$$

group and one —NRH or mixtures thereof, and wherein each R is an H atom or an alkyl group of 1 to 4 carbon atoms.

2. The composition as defined in claim 1 wherein at least one difunctional reactant from (d) is included in said water dissipatable polymer.

3. The composition as defined in claim 1 wherein the metal of the sulfonate group is selected from the group consisting of Na, Li, K, Mg, Ca, Cu, Ni, Fe and mixtures thereof.

4. The composition of claim 1 wherein said oil is selected from (1) mineral oils with a viscosity of about 40 to 60 SUS at 100° C., (2) metal or amine salts of alkyl acid phosphates, or mixtures of (1) and (2).

5. A composition of claim 4 wherein said phosphates have the general formula

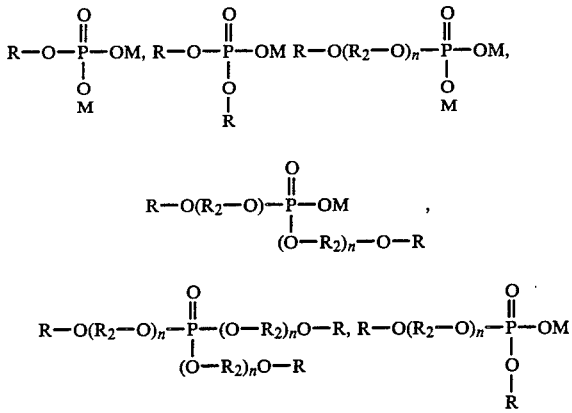

(1) where M is an amine, sodium, potassium or lithium;

(2) R is a carbon atom chain containing from 8 to 22 carbon atoms and the chains can be either saturated or unsaturated; also the R's on any molecule can be alike or different;

(3) $R_2$ is a saturated carbon chain of 2 or 3 carbon atoms;

(4) n is an integer of from 2 to about 20.

6. The composition of claim 1 wherein said oil comprises in weight percent from about 3 to about 5 oleic acid, from about 3 to about 6 diethylaminoethanol, from about 4.5 to about 5.5 1-(2-lactamidoethyl)-2-(heptadecenyl)-2-imidazoline salt of lactic acid, from about 4 to about 7 oxidized neatsfoot oil, from about 50 to about 60 mineral oil 50 SUS at 100° F., from about 3 to about 7 diethylaminoethanol salt of oleyl sulfate, from about 1 to about 3 orthophenylphenol, from about 6 to about 10 2-methoxy-1-methylethylpalmitate, from about 2 to about 5 sorbitan monopalmitate, from about 2 to about 5 poly(oxyethylene)(16) sorbitan monostearate.

7. The composition of claim 1 wherein said oil comprises in weight percent from about 50 to about 60 butyl stearate, from about 20 to about 30 poly(oxyethylene)(8) dinonylphenol, from about 12 to about 18 poly(oxyethylene)(30) castor oil, from about 2 to about 5 sodium dodecylbenzenesulfonate, from about 2 to about 15 polyoxyethylene(5) lauryl potassium phosphate.

8. The composition as defined in claim 6 wherein said polymer is prepared from diethylene glycol and 1,4-cyclohexanedimethanol in a molar ratio of from about 58/47 to about 60/40 and 5-sodiosulfoisophthalic acid and isophthalic acid in a molar ratio of about 16/84 to about 20/80.

9. The composition as defined in claim 7 wherein said polymer is prepared from diethylene glycol and 1,4-cyclohexanediamethanol in a molar ratio of about 53/47 to about 60/40 and 5-sodiosulfoisophthalic acid and isophthalic acid in a molar ratio of about 16/84 to about 20/80.

10. The composition as defined in claim 6 wherein said water dissipatable polymer is prepared from diethylene glycol and 5-sodiosulfoisophthalic acid and isophthalic acid in a molar ratio of about 10/90 to about 13/87.

11. The composition as defined in claim 6 wherein said water dissipatable polymer is prepared from diethylene glycol and hexamethylenediamine in a molar ratio of about 75/25 to about 65/35 and 5-sodiosulfoisophthalic acid and isophthalic acid in a molar ratio of about 16/84 to about 20/80.

12. The composition as defined in claim 7 wherein said water dissipatable polymer is prepared from diethylene glycol and hexamethylenediamine in a molar ratio of about 75/25 to about 65/35 and 5-sodiosulfoisophthalic acid and isophthalic acid in a molar ratio of about 16/84 to about 20/80.

13. A substantially homogeneous composition as defined in claim 1 wherein the ratio of textile emulsifiable finishing oil to water dissipatable polymer is in a ratio by weight of about 96/4 to about 85/15 and the water is about 80 wt. % of the total composition.

14. Textile yarns having dried coatings thereon of any of the compositions defined in any one of claims 1 to 13, said dried coatings being present at a concentration of about 0.5 to about 3.0 wt. % based upon yarn weight.

15. Textile yarns having dried coatings thereon as defined in claim 14 wherein said textile yarns are continuous filament yarns.

16. Textile yarns as defined in claim 14 wherein the yarn is acetate.

17. Textile yarns as defined in claim 14 wherein the yarn is polyester.

18. Textile yarns as defined in claim 14 wherein the yarn is polypropylene.

19. Textile yarns as defined in claim 14 wherein the yarn is acrylic.

20. Textile yarns as defined in claim 1 wherein the yarn is nylon.

* * * * *